United States Patent [19]

Vincoli

[11] Patent Number: 4,580,419

[45] Date of Patent: Apr. 8, 1986

[54] COMPOSITE DIAL NEEDLE FOR A SINGLE-CYLINDER CIRCULAR HOSIERY KNITTING MACHINE FOR PRODUCING RIBBED KNITTING

[75] Inventor: Armando Vincoli, Brescia, Italy

[73] Assignee: Santoni & C. S.p.A., Brescia, Italy

[21] Appl. No.: 593,273

[22] Filed: Mar. 26, 1984

[30] Foreign Application Priority Data

Mar. 30, 1983 [IT] Italy ..... 21328/83[U]

[51] Int. Cl.[4] ..... D04B 35/04

[52] U.S. Cl. ..... 66/123

[58] Field of Search ..... 66/24, 123, 29, 124

[56] References Cited

U.S. PATENT DOCUMENTS

| | | | |
|---|---|---|---|
| 1,418,345 | 6/1922 | Witherell | 66/123 X |
| 2,399,002 | 4/1946 | Coile | 66/24 |
| 2,442,442 | 6/1948 | Shortland | 66/24 |
| 2,622,421 | 12/1952 | Minton | 66/24 |
| 2,626,515 | 1/1953 | St. Pierre | 66/123 X |
| 2,997,865 | 8/1961 | Philip | 66/123 X |

FOREIGN PATENT DOCUMENTS

| | | | |
|---|---|---|---|
| 2847972 | 3/1980 | Fed. Rep. of Germany | 66/123 |
| 1335677 | 7/1963 | France | 66/24 |

*Primary Examiner*—Wm. Carter Reynolds

*Attorney, Agent, or Firm*—Diller, Ramik & Wight

[57] ABSTRACT

A composite dial needle for a single-cylinder circular hosiery knitting machine for producing ribbed knitting which includes a needle and a jack each being defined by a body having a front part, middle part, and a rear part with the bodies in adjacent side-by-side relationship, a drive butt projecting transversely of each middle part, the jack drive butt being at least in part defined by a front edge, the jack front part being appreciably narrower in size than the jack rear part, the jack front part being at least in part defined by an uppermost longitudinal edge disposed below an uppermost longitudinal edge of the jack rear part, a guide part spaced above the jack front part and projecting in a longitudinal direction away from the jack rear part, and the guide part having a lowermost edge spaced from the jack front part uppermost longitudinal edge and defining with a rear portion of the latter a slot opening in a direction away from the jack rear part.

4 Claims, 7 Drawing Figures

COMPOSITE DIAL NEEDLE FOR A SINGLE-CYLINDER CIRCULAR HOSIERY KNITTING MACHINE FOR PRODUCING RIBBED KNITTING

This invention relates to a composite dial needle for use in a single-cylinder circular hosiery knitting machine for producing ribbed knitting.

Circular hosiery knitting machines for producing ribbed knitting are normally provided not only with vertical needles or cylinder needles, but also with a second set of horizontal needles or dial needles. The cylinder needles are required to form the plain stitch rows of the knitted fabric, whereas the dial needles form the purl stitch rows. The needle dial rotates synchronously with the needle cylinder, and is disposed coaxially above said cylinder.

In these machines for producing ribbed knitting, and thus provided with a needle dial, one of the most delicate and critical stages is known to be the transfer of the stitches from the dial needles to the cylinder needles. If this transfer is not done perfectly and with maximum reliability, ladders are formed in the knitted fabric, with a consequent decreased value of the knitted article.

In order to transfer the stitch from the dial needles to the cylinder needles, the pairs of dial and cylinder needles have to be crossed-over so that the cylinder needle becomes inserted into the loop held tightly on the dial needle and the relative sinker.

Various special arrangements have been used in order to facilitate this cross-over between the dial needles and the corresponding cylinder needles. In particular, the dial needles and cylinder needles have been disposed slightly offset from each other, and the dial needles have been provided with lateral cavities in their shanks in order to enable the corresponding cylinder needles to enter. However, these arrangements do not reliably solve the problem of perfectly transferring the stitch from the dial needle to the cylinder needle, because perfect phasing is required between the dial needles and the cylinder needles. This requires high-precision machining of the individual pieces and of the entire motion transmission system, both for the cylinder and for the dial, because even minimum relative risplacements during rotation lead to stitch transfer errors.

To obviate these imperfections, special composite dial needles have been constructed. These known composite needles are provided with a flexible element in the form of a leaf spring fixed rigidly, for example by flanging, to the side of the needle shank provided with the cavity for the passage of the relative needle cylinder during the stitch transfer, said leaf spring extending from the fixing zone to slightly beyond said cavity in the side of the needle, and forming at said cavity a sort of arch opposite the cavity itself, so as to create an eye having a width greater than the thickness of the needle. Besides keeping the already constructed stitch loop opened out, this eye allows more reliable engagement of the loop, because any mutual alignment inaccuracies between the dial needles and the cylinder needles are absorbed by the width of the eye, into which the head of the rising cylinder needle becomes inserted, and which tolerates these inaccuracies, thus making the stitch transfer always perfect.

Although having undoubtedly improved the reliability and accuracy of the stitch transfer stage in circular machines for ribbed knitting production, they are however constructionally complicated, extremely subject to breakage and thus economically disadvantageous. In this respect, the fixing of the leaf spring to the side of the needle shank is a delicate and costly operation, besides requiring modification of the needle shank in order to form a seat suitable for receiving the leaf spring. In addition, the leaf spring, which when the dial needle withdraws towards the dial centre is compelled to rest against the needle with consequent flattening of its distal arch, is subject to considerable fatigue stresses which frequently result in its breakage. Obviously a composite needle of this type with its leaf spring broken cannot be repaired, and must therefore be entirely replaced.

The object of the present invention is therefore to obviate these drawbacks by providing a composite dial needle which is of simpler construction, less subject to breakage and more reliable overall. This object is attained according to the invention by a composite dial needle comprising an actual needle with a drive butt and provided with a cavity formed in one side of its shank, and a flexible element disposed along that side of the needle shank in which said cavity is provided, said flexible element having a distal arch opposite said cavity to form an eye therewith, and terminating in a point beyond said cavity towards the needle head, characterised in that the flexible element is constituted by a jack which is separate from and not joined to the actual needle, and is provided with its own drive butt corresponding to the drive butt of the actual needle.

The fact of having divided the composite needle into two separate parts which are not joined together but are designed to operate simply alongside each other leads to numerous advantages in the construction and use of the composite needle.

Firstly, the needle production is simplified, in that the actual needle can be manufactured as a normal single needle, ie not composite, while the jack to be combined with the actual needle can be produced by normal simple operations from steel strip. The joining together of the two parts of the composite needle as is necessary according to the known art is therefore dispensed with. A further advantage is the fact that in the case of breakage, the two parts of the composite needle, ie the actual needle and the jack, can be replaced independently of each other.

The two parts of the composite needle according to the invention which are inserted alongside each other into the same dial slot or groove are always moved simultaneously and their relative position is maintained constant in the respective dial slot, even though they are independent of and not joined to each other. In this respect, the drive butt of the jack is in the same position as the drive butt of the actual needle when the two parts are alongside each other, so that the jack butt operates against the cams which move the actual needle.

According to a preferred embodiment, the jack of the composite needle possesses a front part, pointing towards the head of the actual needle, which is of smaller height than its rear part, and this front part of reduced height in which the distal arch is formed commences at its drive butt. The front part of reduced height is therefore relatively long so that the bending stress at the point where the front part joins the higher rear part of the jack is small when this latter is retracted into its dial slot, and its front part diverges under the thrust of the cylinder needle which is inserted into the eye of the composite dial needle.

Advantageously, the jack is provided with a guide part which extends forwards from its drive butt above the front part of reduced height, to form an inlet therewith. This guide part suitably increases the guiding of the jack in its dial slot.

It is also advantageous for the terminal rear part of the jack to be slightly bent away from the plane of the jack, towards that side which is to lie alongside the actual needle. In this manner, when the composite needle is inserted into the relative dial slot, said bent rear part of the jack becomes straightened, and by pressing resiliently against the actual needle coupled thereto creates a slight friction which favours common movement between the jack and the relative actual needle.

The characteristics of the composite needle according to the invention will be more apparent from the detailed description of one embodiment given hereinafter with reference to the accompanying drawings, in which.

Figure 1:
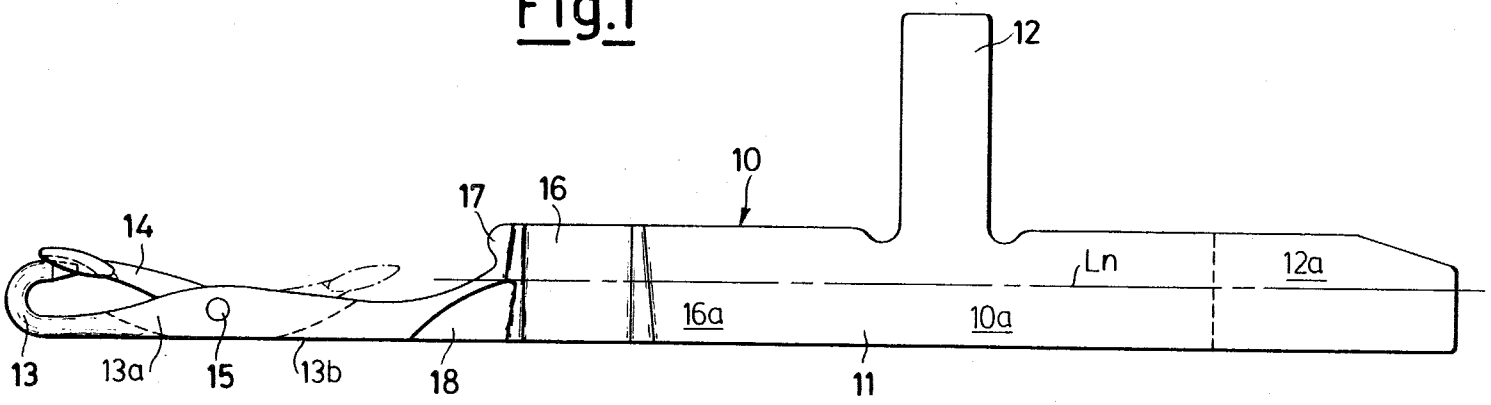
FIGS. 1 and 2 are a side and plan view of the actual needle respectively.
Figure 2:
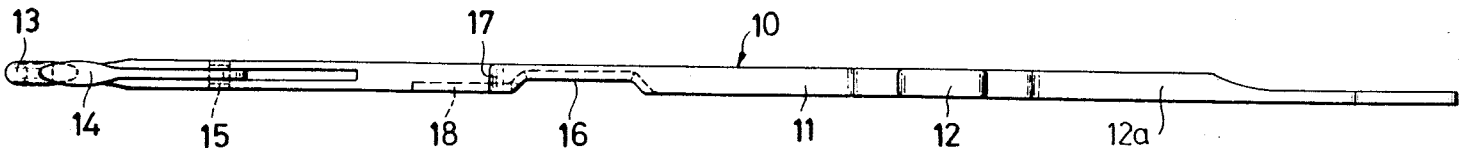

With reference firstly to FIGS. 1 and 2, these show a dial needle, indicated overall by 10 having an elongated body 10*a*, which is of substantially conventional construction and shape and includes a longitudinal axis Ln. It is in the form of a latch needle with a shank 11 provided with a drive butt 12, a hook head 13 and a latch 14 pivoted at 15. In the front part of the shank 11 there is provided on one side a suitably bevelled and tapered cavity 16, as is usual in the known art. To the front of the cavity 16 there is provided on the shank 11 a sort of beak 17 which is arranged to retain the stitch loop formed by the dial needle. In the lower part of the shank 11, again to the front of the cavity 16, there is provided a recess 18, the purpose of which is described hereinafter. The body 10*a* of the dial needle 10 further includes a front part 13*a* having a lowermost edge 13*b*, a middle part 16*a* and a rear part 12*a*.

Figure 3:
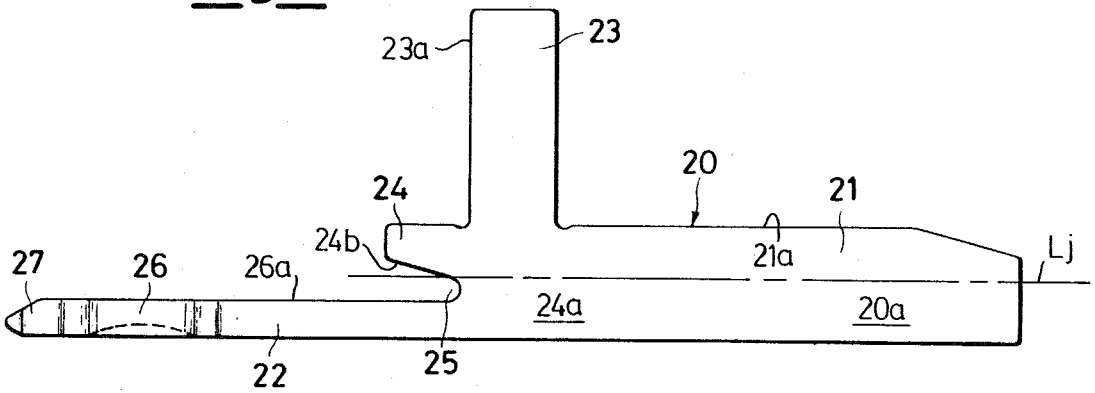
FIGS. 3 and 4 are corresponding views of the jack which is to lie alongside the needle of FIGS. 1 and 2.
Figure 4:
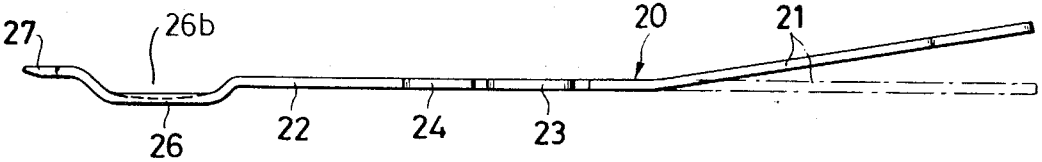

FIGS. 3 and 4 show a jack, indicated overall by 20, having an elongated jack body 20 and a longitudinal axis Lj which is to be coupled to the needle of FIGS. 1 and 2 in order to form the composite needle according to the invention.

The jack 20 is constituted by a suitably shaped thin steel strip, and comprises a rear part 21 having an uppermost longitudinal edge 21*a*, a front part 22, a drive butt 23 having a front edge 23*a* and a guide part 24. In particular, the front part 22 is of considerably less height than the rear part 21, and it commences at the butt 23. The rear part 21 is bent slightly outwards from the plane of the jack 20. The guide part 24 projects forwards from the butt 23 and partially lies above the front part 22, to form an inlet or slot 25 therewith. The inlet or slot 25 is set-off by a lowermost edge 24*b* of the guide part 24 and an uppermost longitudinal edge 26*a* of the front part 22. The slot 25 opens in a direction away from a middle part 24*a* of the jack body 20*a*.

The reduced-height front part 22 of the jack 20 is provided with a distal arch 26 defining a cavity 26*b* which is lowerly bevelled and tapered, and the front part 22 terminates after this arch with a point 27 which is also bevelled and tapered. It should also be noted that the point 27 is slightly displaced from the plane of the jack.

Figure 5:
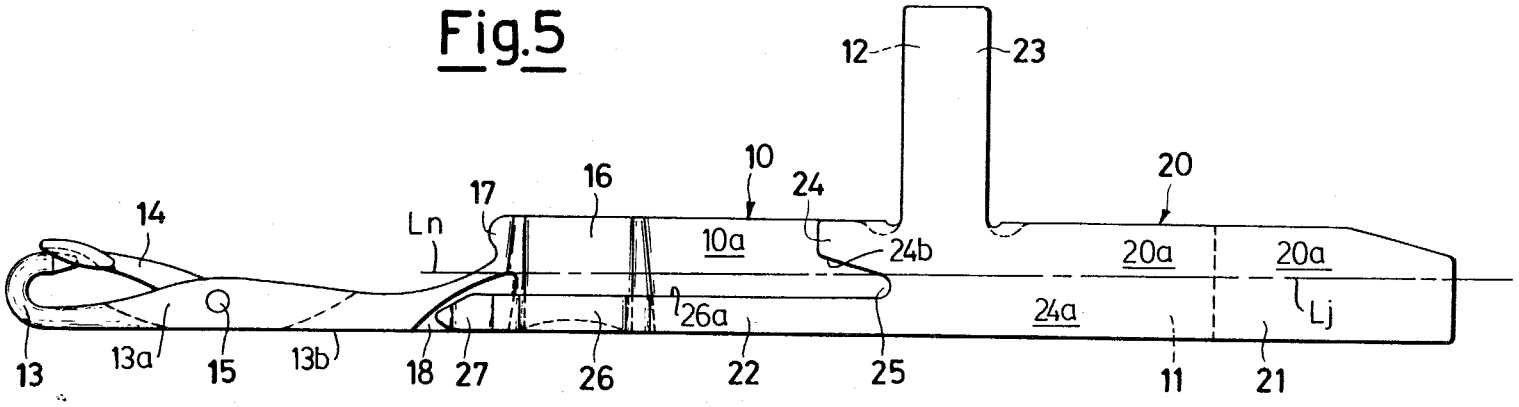
FIGS. 5 and 6 are views corresponding to the preceding, showing the two coupled parts of the composite needle.
Figure 6:
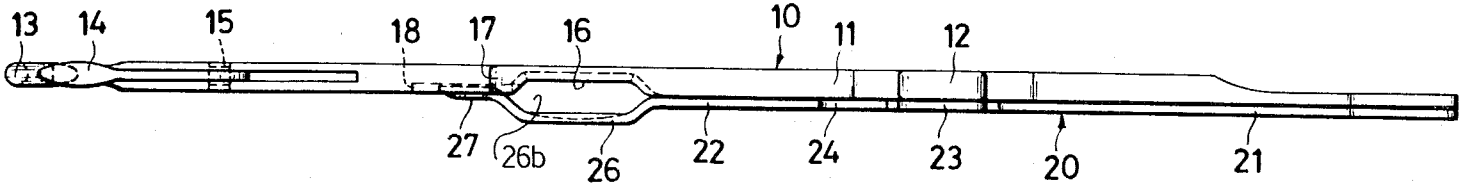

FIGS. 5 and 6 show the needle 10 and jack 20 lying alongside each other to form the composite needle, although the two parts are in no way joined to each other.

Figure 7:
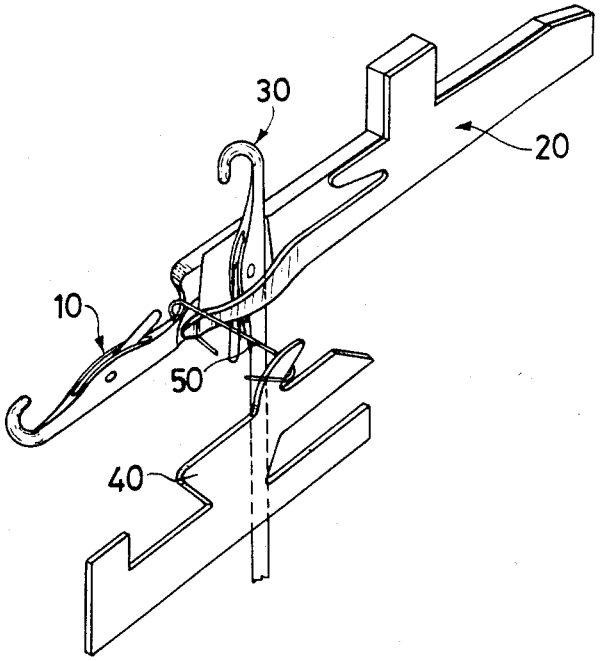
FIG. 7 is a diagrammatic perspective view of the composite needle during the transfer of a stitch to a relative cylinder needle.

From these figures it can be seen that the two parts of the composite needle which are to cooperate with each other are coordinated dimensionally. In particular, it can be seen that the rear part 21 and the butt 23 of the jack 20 have the same dimensions as the corresponding parts of the actual needle 10. It should be noted that the terminal bent part of the jack 20 is straightened when the composite needle is assembled, ie when inserted into a respective slot in the dial (not shown). The cavities 16, 26*b* (FIG. 6) open oppositely relative to each other to receive therein an associated cylinder needle, while the recess 18 is located forwardly of the needle cavity 16 (FIG. 1) and opens through the lowermost edge 13*b* of the front part 13*a* and into the needle cavity 16 to receive the point 27 (FIG. 5) of the jack front part 22. The uppermost longitudinal edge 26*a* of the jack front part 22 is also disposed below the jack body longitudinal axis Lj (FIG. 5). The point 27 of the jack 20 enters the recess 18 of the needle 10, and therefore does not project laterally from it. The distal arch 26 of the jack 20 lies opposite the cavity 16 of the needle 10, to form therewith an eye for the passage of the head of a cylinder needle during transfer of the loop from the composite dial needle to the relative cylinder needle. This stage is illustrated diagrammatically in FIG. 7, which shows a composite dial needle 10, 20, with the corresponding cylinder needle 30 inserted into its eye. For completeness, the relative sinker 40 is also shown, together with the loop 50 to be transferred from the dial needle to the cylinder needle.

The advantages of the composite needle according to the invention are apparent from the aforegoing description. They are due to the fact that the two parts of the composite needle have been made independent and not joined together, so creating a jack suitable for cooperating alongside a relative actual dial needle.

I claim:

1. A composite dial needle for a single-cylinder circular hosiery knitting machine for producing ribbed knitting comprising a needle and a jack each being defined by a front part, a middle part and a rear part disposed in generally adjacent side-by-side relationship, said front, middle and rear parts defining associated elongated needle and jack bodies each having an associated longitudinal axis, a drive butt projecting transversely of each middle part, said jack drive butt being at least in part defined by a front edge, said jack front part being appreciably lesser in height than said jack rear part, said jack front part being at least in part defined by an uppermost longitudinal edge disposed below an uppermost longitudinal edge of said jack rear part, a guide part spaced above said jack front part and projecting in a longitudinal direction away from said jack rear part, and said guide part having a lowermost edge spaced from said jack front part uppermost longitudinal edge and defining with a rear portion of the latter a slot opening in a direction away from said jack rear part.

2. The composite dial needle as defined in claim 1 wherein said needle and jack front parts have oppositely opening opposing cavities adapted to receive therein an associated cylinder needle, a recess in said needle front part forwardly of said needle cavity, and said needle recess opens through a lowermost edge of said needle front part and into said needle cavity whereby a point of said jack front part can be received in and displaced relative to said needle recess.

3. The composite dial needle as defined in claim 1 wherein said jack front part uppermost longitudinal edge is disposed below said jack body longitudinal axis.

4. The composite dial needle as defined in claim 2 wherein said jack front part uppermost longitudinal edge is disposed below said jack body longitudinal axis.

* * * * *